US005819698A

United States Patent [19]

Leighton

[11] Patent Number: 5,819,698

[45] Date of Patent: Oct. 13, 1998

[54] ENGINE CONDITION MONITORING SYSTEM

[75] Inventor: Harold Leighton, Fort Mill, S.C.

[73] Assignee: Pioneer/Eclipse Corporation, Sparta, N.C.

[21] Appl. No.: 719,118

[22] Filed: Sep. 24, 1996

[51] Int. Cl.[6] ..... F02B 77/08

[52] U.S. Cl. ..... 123/198 DC; 123/198 D

[58] Field of Search ..... 123/198 DC, 198 D

[56] References Cited

U.S. PATENT DOCUMENTS

| | | | |
|---|---|---|---|
| 4,598,682 | 7/1986 | Miyano et al. | 123/440 |
| 5,117,802 | 6/1992 | Durbin | 123/577 |
| 5,218,945 | 6/1993 | Kapellan et al. | 123/687 |
| 5,237,983 | 8/1993 | Willey et al. | 123/688 |
| 5,357,938 | 10/1994 | Bedford et al. | 123/527 |
| 5,377,646 | 1/1995 | Chasteen | 123/685 |
| 5,379,740 | 1/1995 | Moore et al. | 123/478 |
| 5,415,136 | 5/1995 | Doherty et al. | 123/46 |
| 5,426,934 | 6/1995 | Hunt et al. | 60/276 |

*Primary Examiner*—Erick R. Solis
*Attorney, Agent, or Firm*—McDermott, Will & Emery

[57] ABSTRACT

An engine condition monitoring system includes a sensor for producing a sensor signal representing the oxygen content of the exhaust gas of a small internal combustion engine in a floor buffer fueled by propane or other form of natural gas. A micro-processor, operating in accordance with programming instructions stored in an EPROM, processes the received sensor signal, determines whether the engine is operating in one of four categories: normal, warning, idle and shut down, and generates an output signal indicative of the determined category. The output signal is used to provide a visual display of the engine's condition on red and green LEDs and/or shut down the engine by shorting the ignition circuit.

24 Claims, 5 Drawing Sheets

ENGINE CONDITION MONITORING SYSTEM

BACKGROUND OF THE INVENTION

1. Field of the Invention

The invention relates generally to engine condition monitoring systems and methods. More particularly, the present invention relates to systems and methods for monitoring the operating condition of a gas fueled small engine used in an air space with restricted ventilation.

2. Description of the Related Art

Small internal combustion engines are sometimes used to power various types of manually operated equipment. These engines are normally fueled by gasoline or by propane or other forms of natural gas. Certain types of equipment, floor buffers for example, may be left unattended with the engine running even though the equipment is not being operated, thus resulting in the unnecessary waste of fuel.

In addition, the exhaust gas of these engines contains carbon monoxide and may create unsafe conditions when used indoors or in a space in which ventilation is restricted. In particular, since carbon monoxide is invisible and odorless, if an engine continues to run when equipment is unattended or if the operator has become disabled such as by slipping and falling while operating the equipment, there is a risk that the exhaust of the engine may create an unsafe breathing environment. This is especially true for some types of equipment which do not pose a high risk of immediate physical injury, such as a floor buffer for example, and which lack safeguards to prevent the equipment from continuing to run even though the operator is not present or is disabled.

Equipment powered by small gas fueled engines is available which contains safeguards to control the engine when the operator is not present or is disabled. However, these safeguards generally consist of hand levers which turn off the engine if they are not engaged during operation of the equipment. They therefore suffer from the problem that the engine may be turned off even though an operator is present but has inadvertently released the lever. Such mechanical safeguards are also easily subject to tampering.

Internal combustion engine control systems are known in the prior art which monitor the engine using an exhaust gas sensor and/or other types of sensors. However, these control systems generally use the sensor data for controlling the fuel/air mix or other factors affecting the efficiency of the engine (See, for example, U.S. Pat. No. 5,357,938 to Bedford et al and U.S. Pat. No. 5,426,934 to Hunt et al.) rather than for indicating safe oxygen levels for operation indoors, displaying the engine operating condition to an operator and/or determining excessive idling caused by, for example, a missing or disabled operator.

SUMMARY OF THE INVENTION

It is therefore an object of the present invention to overcome the aforementioned disadvantages in the known prior art. In particular, it is an object of the present invention to provide a reliable system and method of monitoring and visually indicating the condition of the exhaust of an internal combustion engine which also prevents the unnecessary waste of fuel and which is not easily subject to tampering.

The present invention provides a novel engine condition monitoring system and method which effectively monitors the condition of the exhaust of the engine. A key feature of the system is that a processor is programmed to automatically determine and visually indicate the condition of the engine on the basis of a signal from an oxygen sensor located in the exhaust flow path. Data from the sensor is used to indicate acceptable safe levels of oxygen and, by inference, discern carbon monoxide in the engine exhaust.

In accordance with a preferred embodiment of the present invention, an engine condition monitoring system includes a conventional lambda sensor, such as that used in the engines of automobiles, for producing a signal representing the oxygen content of the exhaust gas of said engine. However, the preferred embodiment of the invention uses the output of the lambda sensor to indicate the condition of the engine in a manner which is meaningful to the operator of equipment powered by the engine. The conditions related to specific sensor output readings are defined as Idle, Normal, Warning and Shut Down. A processor operating in accordance with stored programming instructions processes the received sensor signal, determines whether the engine is operating in one of the plurality of different conditions, and generates an output signal indicative of the determined condition. The output signal is used to provide a visual display of the engine's condition on different color light emitting diodes and/or shut down the engine by shorting the ignition circuit.

The advantages and novel features of the present invention will become apparent to those skilled in the art from this disclosure, including the following detail description, as well as by practice of the invention. While the invention is described below with reference to preferred embodiments, it should be understood that the invention is not limited thereto. Those of ordinary skill in the art having access to the teachings herein will recognize additional applications, modifications and embodiments in the same or other fields, which are within the scope of the invention as disclosed and claimed herein and with respect to which the invention could be of significant utility.

DETAILED DESCRIPTION OF THE PREFERRED EMBODIMENTS

Figure 1:
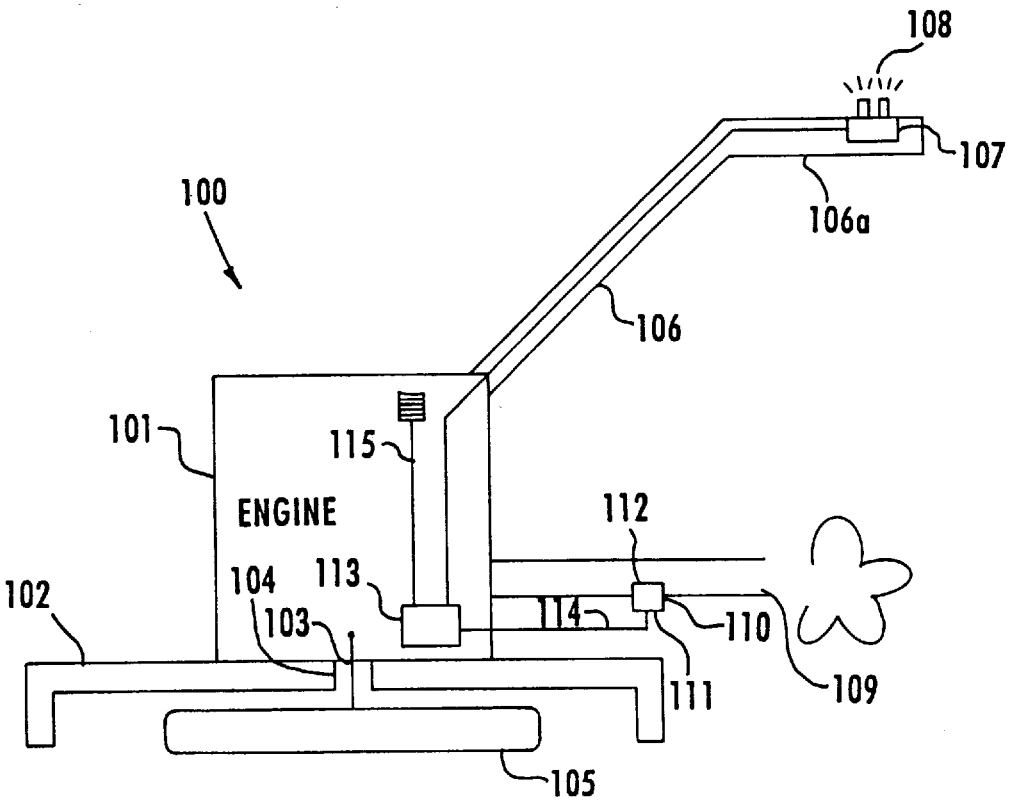
FIG. 1 is a perspective view of an exemplary piece of equipment implementing a preferred embodiment of the engine condition monitoring system in accordance with the present invention.

The engine condition monitoring system and method in accordance with the present invention will now be described with reference to FIGS. 1–5. FIG. 1 is is a perspective view of a floor buffer 100 on which the engine condition monitoring system and method are carried out. The floor buffer 100 has a small internal combustion engine 101 mounted on the top surface of a platform 102. Engine 101 drives a rotary shaft 103 extending through a hole 104 in the top surface of platform 102 and connecting to buffing material 105 in contact with the floor. The floor buffer 100 has a handle frame 106 connected to platform 102 and including a grip portion 106*a* located at least several feet above the floor surface so as to be gripped by an operator. The grip portion 106*a* encloses or supports a dashboard or other surface 107 which may contain operator controls or written printed information related to the operation of the floor buffer 100. The dashboard or surface 107 includes at least a plurality of bright red and green light emitting diodes (LEDS) 108 for use in the engine condition monitoring system and method.

Engine 101 contains a 12 volt battery, a supply of fuel, a spark plug, an ignition circuit containing a solenoid for supplying a spark to the spark plug (not shown), and an exhaust system pipe 109 for carrying exhaust gas away from the engine. The engine is preferably fueled by propane or another form of natural gas. A threaded hole 110 is provided in exhaust system pipe 109 and a sensor assembly 111 with a threaded bolt is screwed into threaded hole 110 so that oxygen sensor 112 is inserted into the flow of exhaust gases through exhaust system pipe 109. If the engine has a catalytic converter, then the sensor is inserted at a point between the engine and the catalytic converter. The electronics for the engine condition monitoring system are preferably contained on a single, small printed circuit board 113, which is connected by wires to receive a sensor signal 114 from oxygen sensor 112 of the sensor assembly 111, to receive an ignition signal 115 from the ignition circuit of engine 101 and to shut down ignition circuit of engine 101 and to drive LEDs 108 in accordance with an operation described below. Circuit board 113 is preferably installed on the engine 101, but it may be installed at any suitable location on buffer 100.

Figure 2:
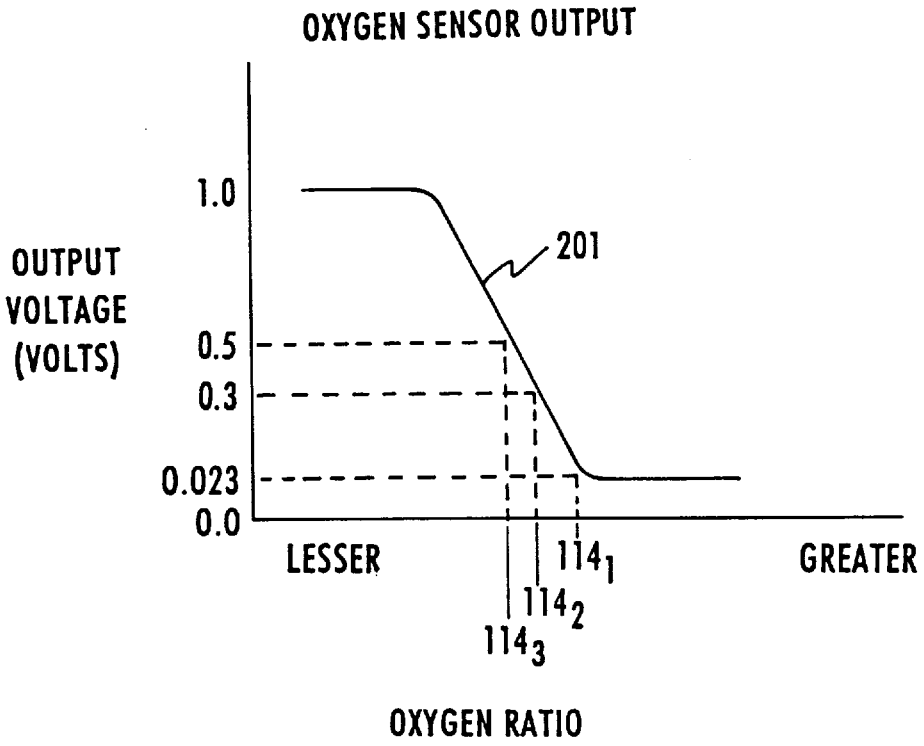
FIG. 2 is a graph showing the output characteristics of an oxygen sensor used in the engine condition monitoring system in accordance with a preferred embodiment of the present invention.

Oxygen sensor 112 is preferably a lambda (λ) sensor sometimes used in air/fuel mix control systems to indicate the air/fuel or equivalence ratio of engine exhaust. The lambda sensor generates an analog output signal from an electrochemical reaction that is dependent upon the relative oxygen content of the exhaust. The output voltage varies between slightly more than 0 volt when the exhaust is in the very most lean condition (ratio of oxygen is highest) and about 1 volt when the exhaust is richest (the ratio of oxygen is lowest). Line 201 in FIG. 2 illustrates the relationship of the output signal to the ratio of oxygen present in the exhaust gas when the lambda sensor is operating at its nominal operating temperature.

As will be explained in more detail below, circuitry in the preferred embodiment of the engine condition monitoring system categorizes the engine into one of six different conditions on the basis of the sensor signal 114 and ignition signal 115. The six conditions are summarized in Table 1.

TABLE 1

| SENSOR SIGNAL OUTPUT | "SENSOR ZONE" | LED STATUS |
|---|---|---|
| ignore | Warm up | slow flash green |
| ignore | Idle Time Out | fast flash green |
| 0.000–0.023 v | Shutdown (short) | solid red |
| 0.023–0.300 v | Normal | solid green |
| 0.300–0.500 v | Warning | flashing red |
| 0.500 & above | Shutdown | solid red |

The first condition is a warm-up period which occurs for a predetermined period of time immediately following the starting of engine 101 so that oxygen sensor can achieve a steady state operating condition. It does not depend upon either one of the sensor signal 114 or the ignition signal 115.

In the second "Idle Time-Out" condition, the sensor signal 114 is ignored and the engine is categorized as operating in the second condition based solely on the value of the ignition signal 115 and the duration of that value.

The remaining four of the six conditions are based solely on the value of the sensor signal 114 and are categorized according to three output voltage values. While the ranges of the four conditions are specified by threshold values $\mathbf{114}_1$, $\mathbf{114}_2$ and $\mathbf{114}_3$ given in Table 1 and shown in FIG. 2, it should be kept in mind that many factors (hydrocarbon content, exhaust temperature, exhaust velocity, exhaust mixing, etc.) affect the relationship between the oxygen content and the concentration of carbon monoxide detected by oxygen sensor 112. Therefore, operating conditions and characteristics of the engine 101 and the sensor 112 should be taken into account and the specific threshold values $\mathbf{114}_1$, $\mathbf{114}_2$ and $\mathbf{114}_3$ adjusted accordingly.

Figure 3:
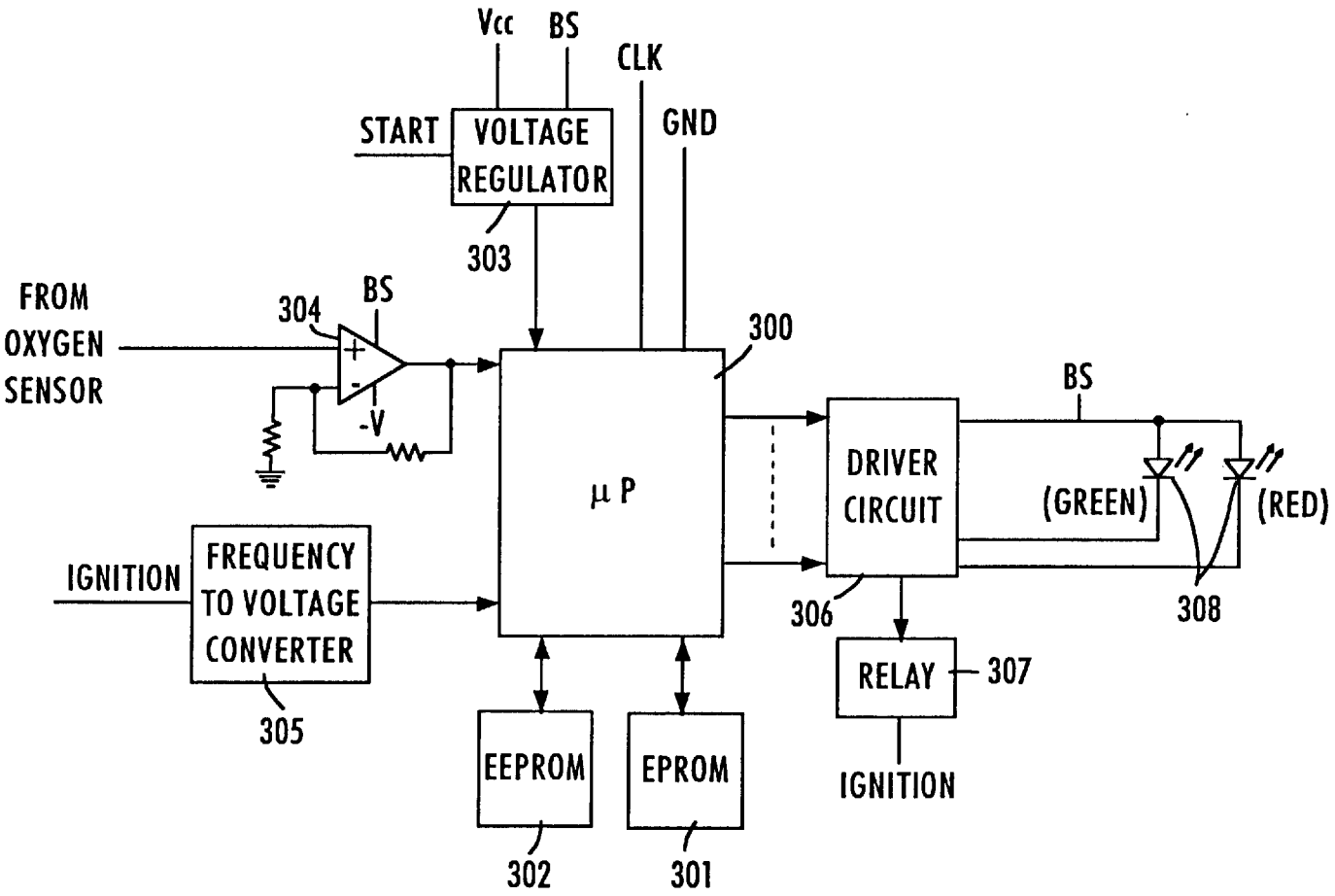
FIG. 3 is a block diagram of the circuit in the engine condition monitoring system in accordance with a preferred embodiment of the present invention.

A block diagram of the circuit on circuit board 113 is shown in FIG. 3. At the center of the circuit is a microprocessor integrated circuit (IC) 300. Microprocessor 300 is connected to an EEPROM 301 and to an EPROM 302. Although microprocessor 300 and EPROM 302 are shown as separate elements in FIG. 3 for the sake of clarity, it is preferred that microprocessor 300 comprise a Motorola MC68HC705P9 microprocessor which contains its own internal one-time programmable EPROM. In either case the program instructions for carrying out all of the described procedures and subroutines are stored in EPROM 302 and the processing circuitry is included in microprocessor 300. The source code for the preferred embodiment of the invention (23 pages) is included as an appendix to this specification.

As mentioned previously, the engine and floor buffer shown in FIG. 1 are merely exemplary. It is contemplated that circuit board 113 may be installed on different engines and/or equipment. The preferred embodiment therefore employs an EEPROM 301 in addition to EPROM 302, which differs from EPROM 302 insofar as information can be erased therefrom and written thereto repeatedly. The EEPROM 301 preferably stores, at the time of installation of circuit board 113 for example, calibration values for the input and output signals, as well as any other values which may change from installation to installation, such as the specific threshold values for the sensor signal 114 and the time periods used in various timers. EEPROM 301 may also be used to store other information, such as data indicating the length of time the engine has been running.

Microprocessor 300 operates off of a clock signal CLK generated by an oscillator on circuit board 113 as well as a supply voltage from voltage regulator 303. The voltage regulator 303 preferably operates on a nominal 12–14 volts dc with over voltage protection to 35 volts dc and reverse polarity protection. The voltage regulator 303 is also configured to receive a start signal which is activated upon the supply of power to the ignition solenoid in engine 101 and which provides power to circuit board 113. A battery switch lead is also provided to voltage regulator 303 and to the microprocessor 300, op amp 304 and the LED driving circuit 306.

The presence of ignition pulses from engine 101 serve as a "running" input to the circuit on circuit board 113. Sensor signal 114 is provided as an input to microprocessor 300 via operational amplifier 304 and ignition signal 115 is provided as an input via a frequency to voltage converter 305. Microprocessor 300 receives and processes sensor signal 114 and ignition signal 115 in the manner described below and outputs signals to drive LEDs 108 via a driving circuit 306, preferably of Darlington configuration. There is also a relay 307 which serves to short the ignition circuit in engine 101 as part of the operation shown in FIGS. 4 and 6.

Figure 4:
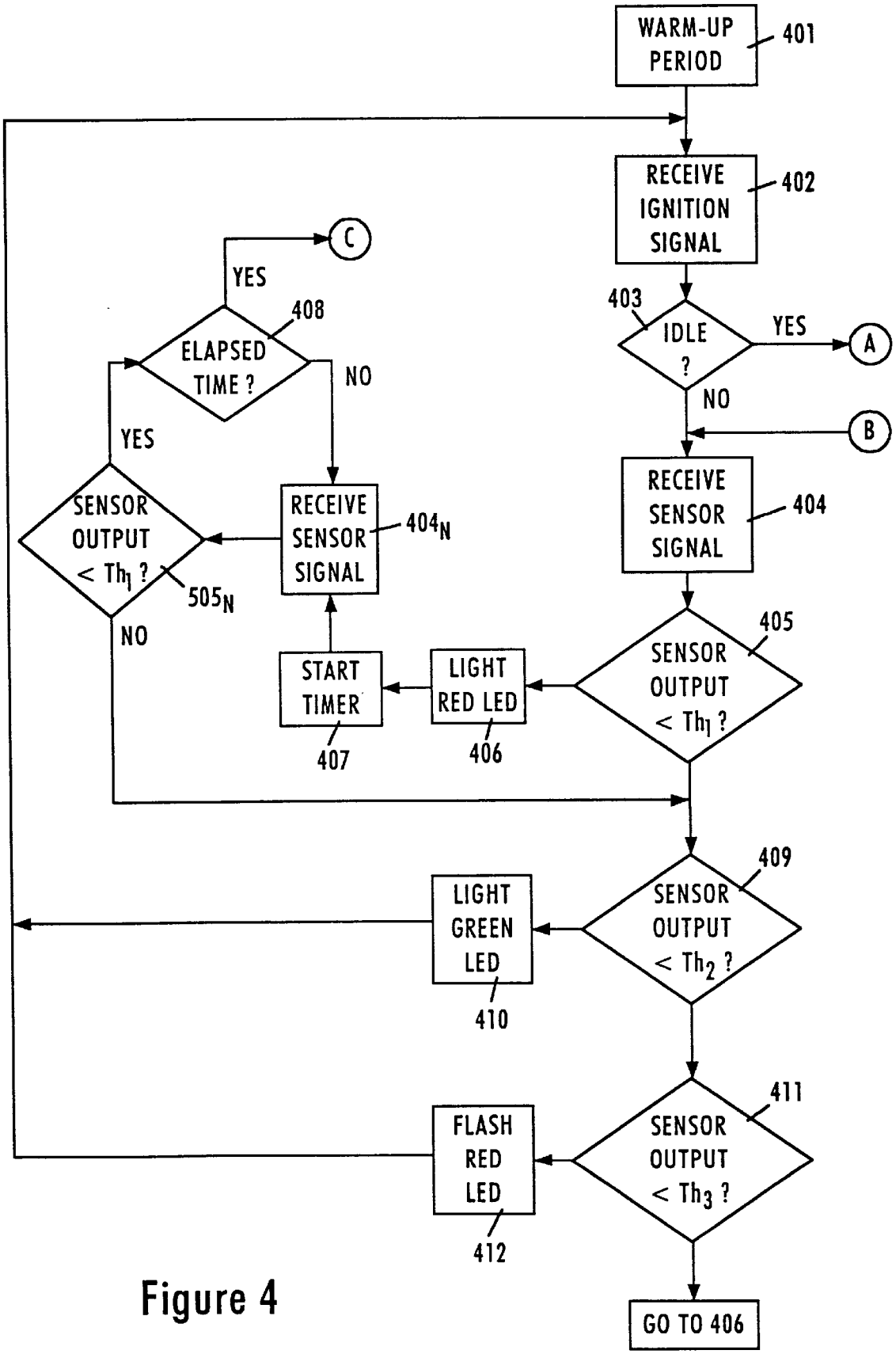
FIG. 4 is a flowchart of the operation of the engine condition monitoring system carried out according to programmed instructions stored in the circuit shown in FIG. 3.

Operation of the engine condition monitoring system will now be described with reference to FIG. 4. Upon starting of engine 101, microprocessor 300 on circuit board 113 ignores the sensor signal 114 and the ignition signal 115 for a predetermined warm-up period (step 401), preferably about 3 minutes. During this warm-up period, the microprocessor outputs a signal causing the green LED to flash slowly.

After the warm-up period 401 has ended, microprocessor 300 commences to receive and monitor ignition signal 115 (step 402) and then determine whether engine 101 is idling (step 403). The engine is determined to be idling if the engine speed, as indicated by the frequency of pulses corresponding to the firing of the spark plug, on ignition signal 115 is less than a predetermined amount. While the predetermined amount is set at 2150 rpm in the preferred embodiment, it will be varied according to the specifications of engine 101. If it is determined that engine 101 is idling, then the circuit enters and performs the idle timeout subroutine shown in FIG. 5.

If it is determined that engine 101 is not idling, then the microprocessor receives and monitors sensor signal 114 (step 404) and subsequently performs a series of comparisons between the output voltage of sensor signal 114 and each one of the three specific threshold values $\mathbf{114}_1$, $\mathbf{114}_2$ and $\mathbf{114}_3$. If the output voltage of sensor signal 114 is less than specific threshold value $\mathbf{114}_1$ (0.023 v in the preferred embodiment) (step 405), then the engine is determined to be in a "shutdown" condition and the microprocessor outputs a signal which causes the red LED to be illuminated continuously (step 406) (the green LED is turned off if it is on) and which starts an internal timer (step 407).

The microprocessor then receives a subsequent output voltage of sensor signal 114 at step $\mathbf{404}_N$ (this step is identical to step 404 except, of course, that the output voltage corresponds to the oxygen content of the exhaust at a slightly later point in time) and determines, at step $\mathbf{405}_N$, if the subsequent output voltage of sensor signal 114 is also less than specific threshold value $\mathbf{114}_1$ (this step is identical to step 405 except that it is slightly later in time). If the subsequent output voltage of sensor signal 114 is less than specific threshold value $\mathbf{114}_1$, then the microprocessor determines if a predetermined period of time has elapsed (preferably about one minute) since the engine was first detected as operating in the shutdown condition (step 408). If not, steps $\mathbf{404}_N$, $\mathbf{405}_N$ and 408 are repeated until the predetermined time has elapsed or a subsequent output voltage of sensor signal 114 is not less than specific threshold value $\mathbf{114}_1$.

If the predetermined period of time in step 408 elapses, the system then shuts down the engine according to a shut down procedure (step 413) which is also stored in the circuit and carried out by microprocessor 300 through a relay 307 to the ignition circuit in engine 101. The system then waits 20 seconds (step 414) and turns off the red LED and the power to the printed circuit board (step 415).

If an output voltage of sensor signal 114 is determined to not be less than specific threshold value $\mathbf{114}_1$ in either one of steps 405 and $\mathbf{405}_N$, then microprocessor 300 next determines if the output voltage of sensor signal 114 is less than specific threshold value $\mathbf{114}_2$ (0.300 v in the preferred embodiment) (step 409). If it is, then the engine is determined to be in a normal condition and microprocessor 300 outputs a signal which causes the green LED to be illuminated continuously (step 410) (the red LED is turned off if it is on or flashing) and the process then returns to step 402 and continues to receive, monitor and process subsequent values of the sensor signal and the ignition signal.

If the output voltage of sensor signal 114 is not less than specific threshold value $\mathbf{114}_2$ in step 409, then microprocessor 300 next determines if the output voltage of sensor signal 114 is less than specific threshold value $\mathbf{114}_3$ (0.500 v in the preferred embodiment) (step 411). If it is, then the engine is determined to be in a "warning" condition and microprocessor 300 outputs a signal which causes the red LED to flash (step 412) (the green LED is turned off if it is on) and the process then returns to step 402 and continues to receive, monitor and process subsequent values of the sensor signal and the ignition signal. Consequently, when the engine is operating in either the normal condition or the warning condition, the system simply displays the condition of the engine and then continues to receive, monitor and process subsequent values of the sensor signal and the ignition signal.

If the output voltage of sensor signal 114 is not less than specific threshold value $\mathbf{114}_3$ (0.500 v in the preferred embodiment) (step 405), then the engine is determined to be in the "shutdown" condition and the process goes to step 406 and enters the timing procedure of steps 407, $\mathbf{404}_N$, $\mathbf{405}_N$ (check for signal $\geqq th_3$) and 408 in the manner described above.

Figure 5:
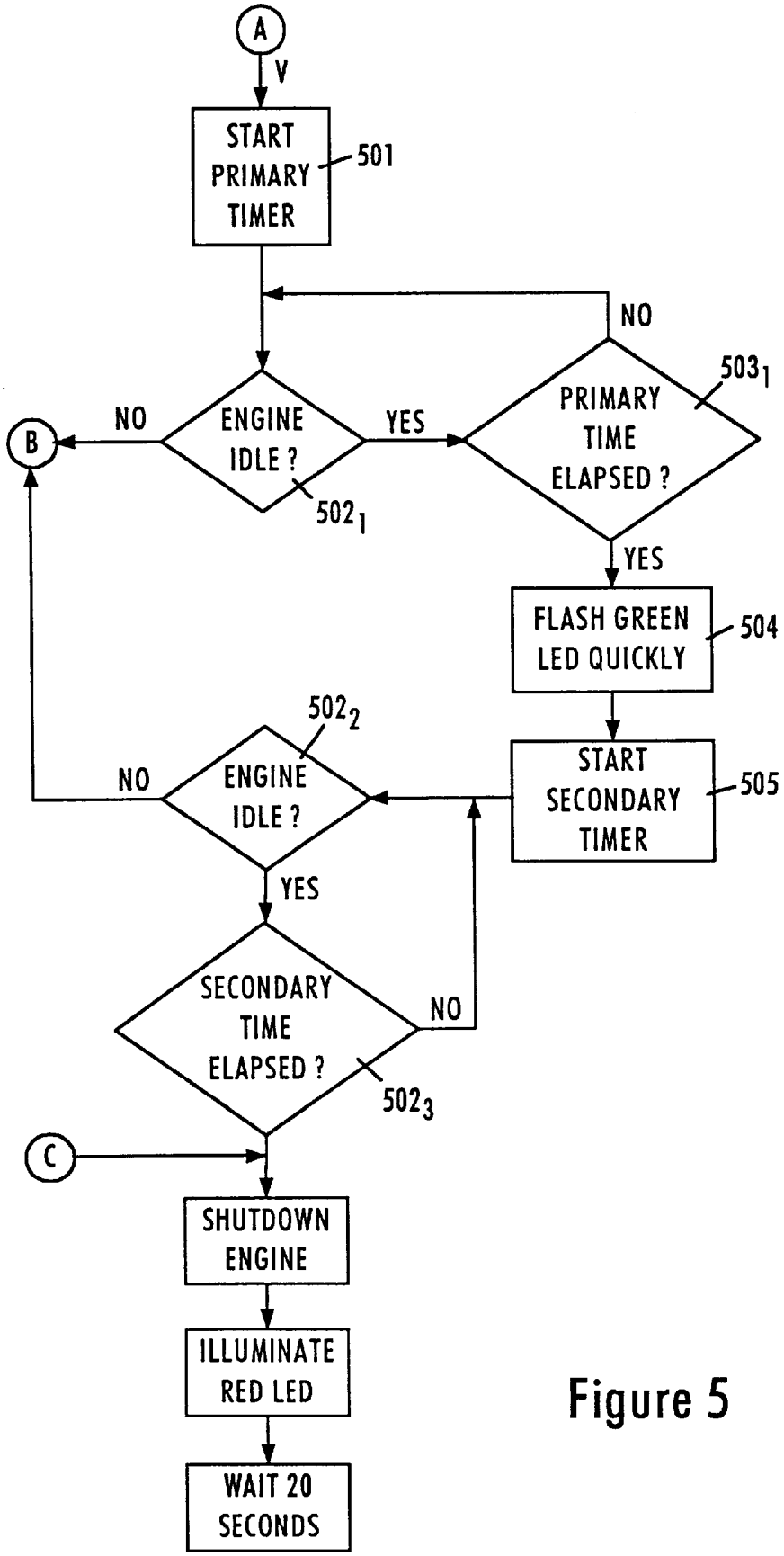
FIG. 5 is a flowchart of an idle timeout subroutine of the operation of the engine condition monitoring system according to the preferred embodiment of the present invention.
Figure 3:
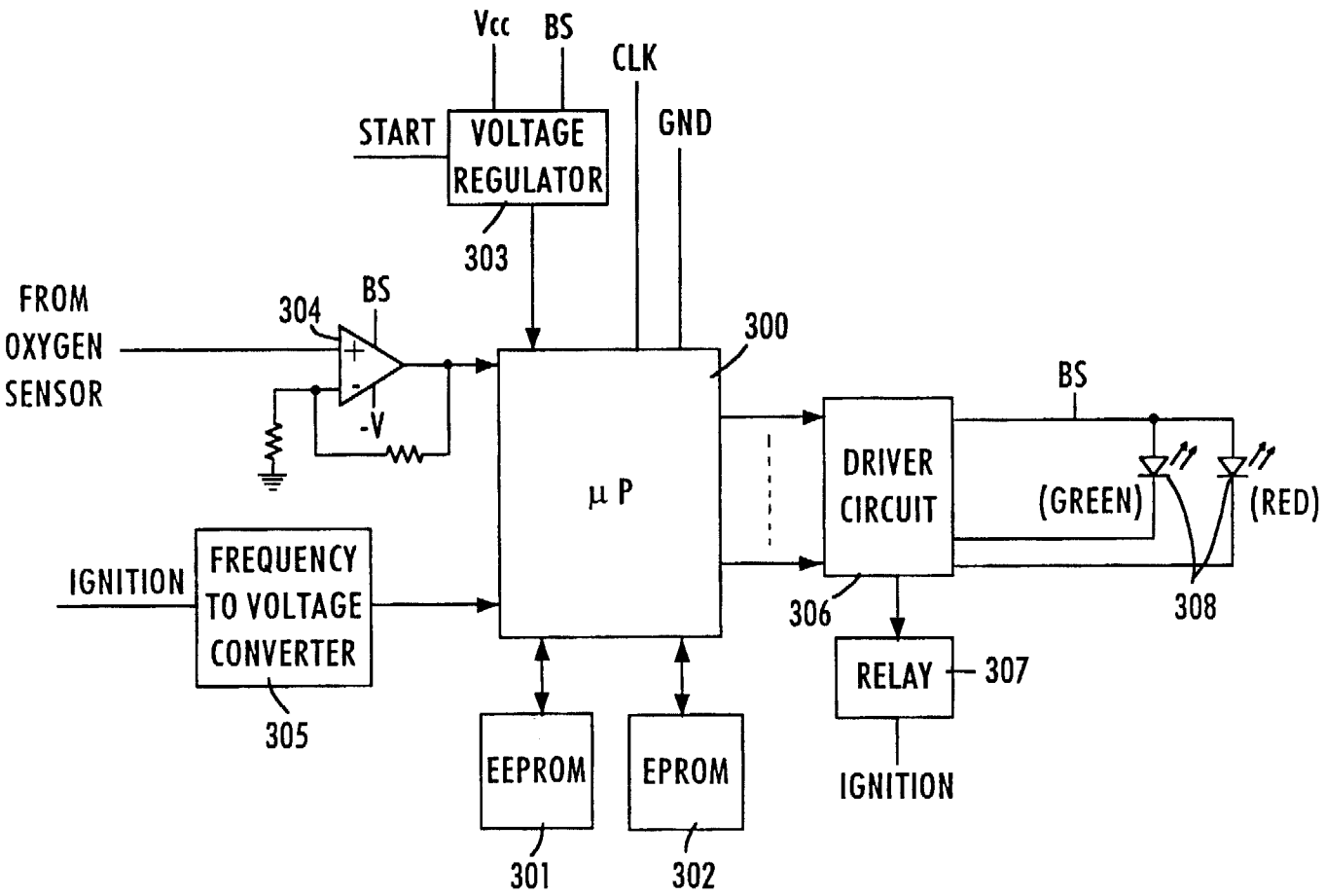
Figure 4:
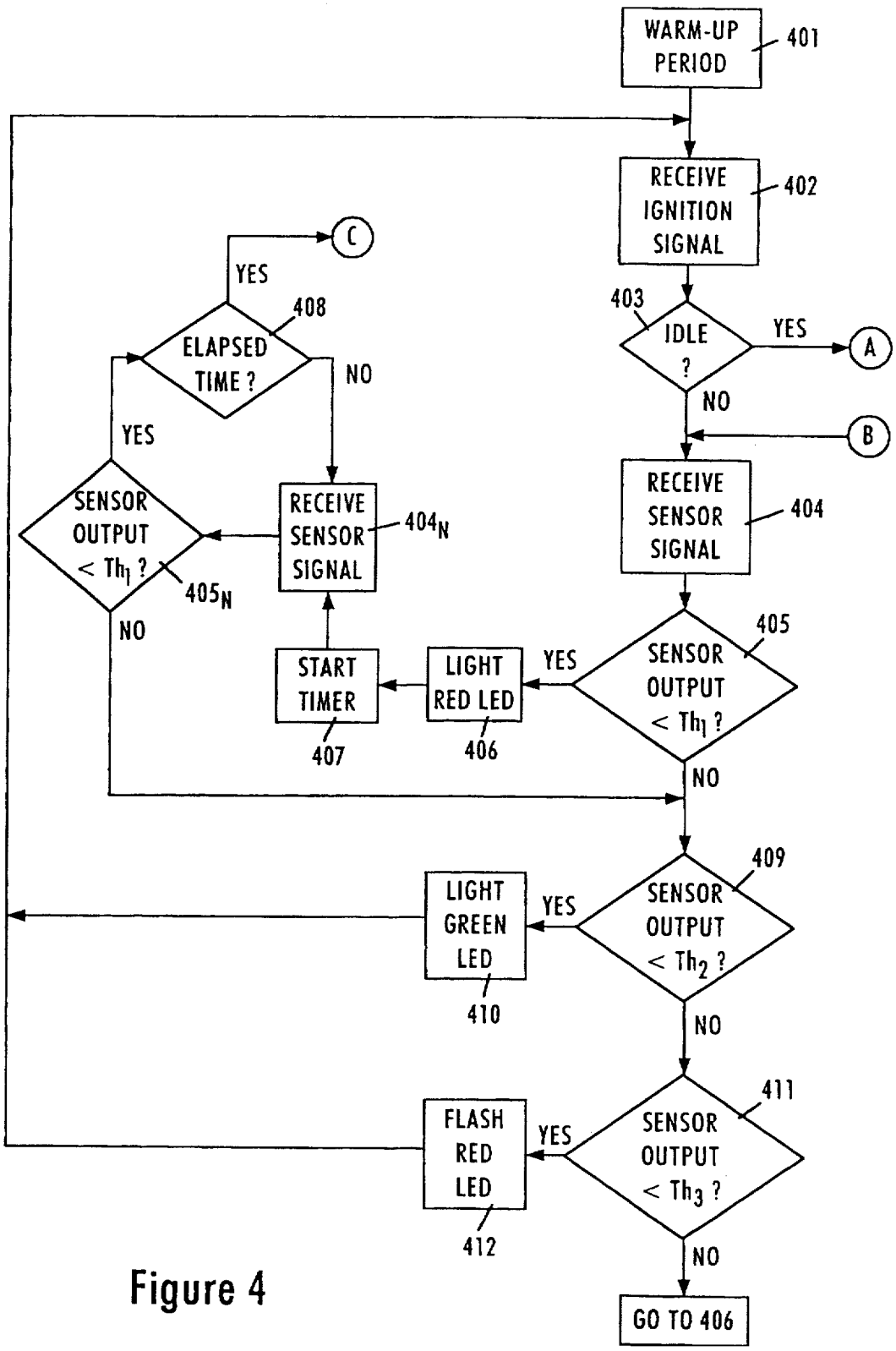
Figure 5:
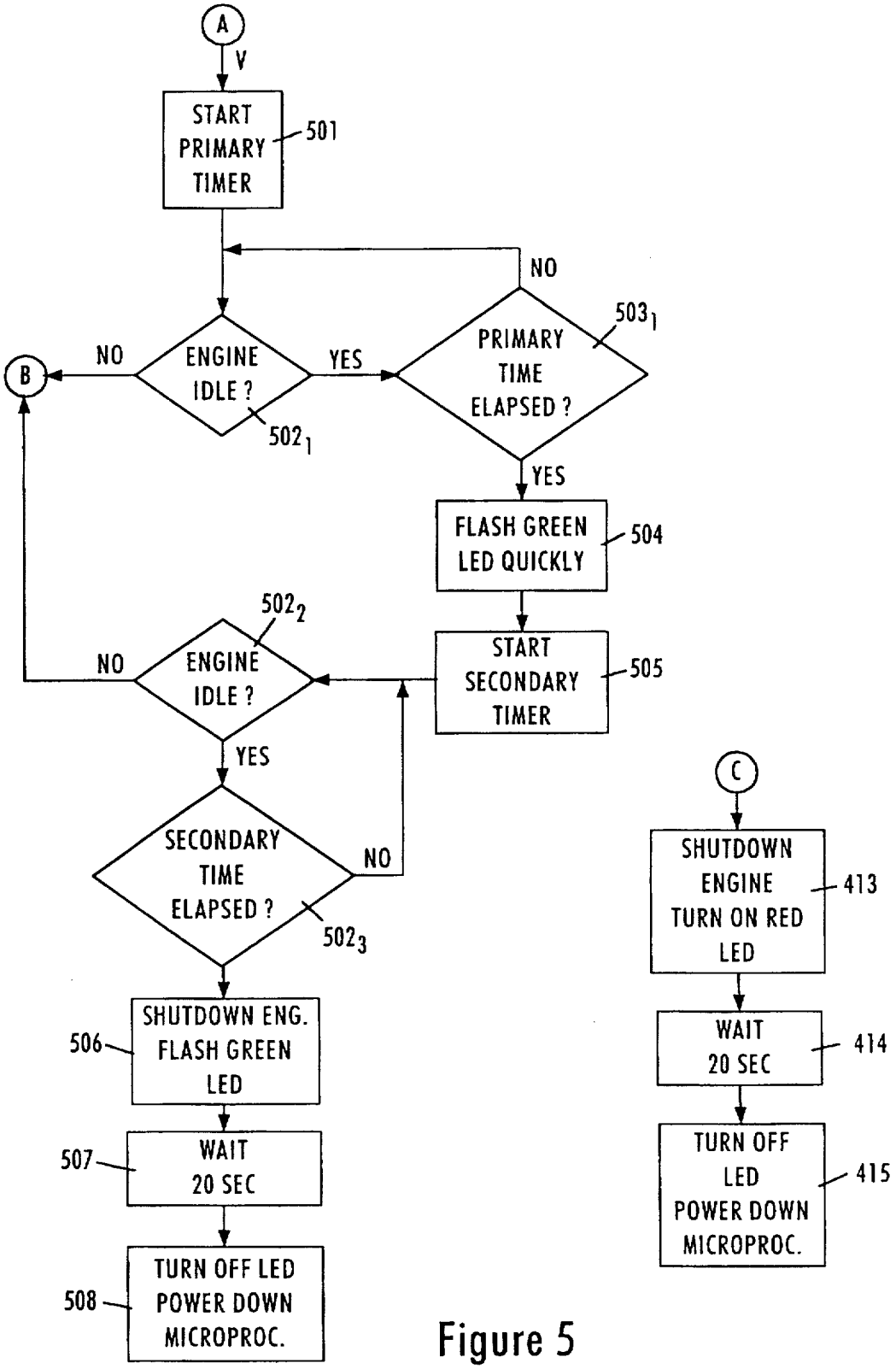

The flowchart of the idle subroutine, performed when the engine is operating in the second "idle time-out" condition in Table 1, is shown in FIG. 5. As mentioned previously, the idle subroutine is entered when it is determined in step 403 that the engine is idling. The ignition signal 115 is comprised of a series of pulses with the frequency of the pulses indicating the engine speed. A frequency to voltage converter 305 conditions the pulses to be received by microprocessor 300 to be processed to determine the equivalent engine speed. In step 501, the program starts an idle timer. In step $\mathbf{502}_1$, the microprocessor 300 repeats the step of determining whether the engine is idling (this step is identical to step 403 except that it occurs with at a slightly later point in time) . If the engine is not still idling, then the idle subroutine is exited and the program proceeds with step 404 shown in FIG. 4. If the engine is still idling, then the idle subroutine checks to see if the period of time set in the idle timer (preferably about two minutes) has elapsed (step $\mathbf{503}_1$). If not, the idle subroutine returns to step $\mathbf{502}_1$ and repeats steps $\mathbf{502}_1$ and $\mathbf{503}_1$ until either the engine is no longer idling or the period of time set in the idle timer has elapsed.

If and when the period of time set in the idle timer elapses, the microprocessor 300 outputs a signal which causes the green LED to flash quickly (step 504) and starts a second period of time (preferably about one minute) in step 505. In step $\mathbf{502}_2$, the microprocessor 300 repeats the step of determining whether the engine is idling (this step is identical to step $\mathbf{502}_1$ except that it occurs with at a slightly later point in time). If the engine is not still idling, then the idle subroutine is exited and the program proceeds with step 404 shown in FIG. 4. If the engine is still idling, then the idle subroutine checks to see if the period of time set in the secondary timer has elapsed (step $\mathbf{502}_3$). If not, the idle subroutine returns to step $\mathbf{502}_2$ and repeats steps $\mathbf{502}_2$ and $\mathbf{502}_3$ until either the engine is no longer idling or the period of time set in the secondary timer has elapsed. If and when the period of time set in the secondary timer elapses, the system then shuts down the engine (step 506).

The shut down procedure is controlled by the microprocessor 300 through a relay 307 to the ignition circuit in engine 101. As explained above, the engine may be shut down either because of the value of the sensor signal 114 or because the engine has been idling excessively, as determined on the basis of ignition signal 115. In either case, the condition must persist for a predetermined period of time before the engine is shutdown. The circuit will maintain power for 20 seconds after engine shutdown (step 507) and will then turn off the green LED and power itself off (step 508).

As described above, the invention thus overcomes the problems of the unnecessary waste of fuel and potentially unsafe breathing conditions caused by excessive idling. The invention also provides an effective system and method for monitoring the condition of an engine and immediately providing a display thereof to the operator.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

The detailed descriptions are presented in terms of program procedures executed by a microprocessor. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a program stored in memory. The procedures presented herein are not inherently related to a particular microprocessor or other apparatus. Various general purpose machines may be used with programs written in accordance with the teachings herein, or it may prove more convenient to construct more specialized apparatus to perform the required method steps. The required structure for a variety of these machines will appear from the description given.

What is claimed is:

1. An engine condition monitoring system, comprising: a sensor configured to receive the exhaust gas of said engine and to produce a sensor signal representing the oxygen content of said exhaust gas;

a processor configured to receive and process said sensor signal, to categorize said engine as operating in one of a plurality of different engine conditions on the basis of said sensor signal, and to generate an output signal representing said one of said plurality of engine conditions, wherein the plurality of engine conditions comprises a normal condition, a warning condition, an idling condition and a shutdown condition; and a display configured to receive said output signal generated by said processor and to operate in a display state respectively corresponding to said one of said plurality of engine conditions.

2. A system according to claim 1, wherein said processor is configured to further receive an ignition signal representing the engine speed of said engine, to process said sensor signal and said ignition signal, and to determine whether said engine is operating in one of the plurality of different engine conditions on the basis of said sensor signal and said ignition signal.

3. A system according to claim 1, wherein said display comprises a plurality of light emitting diodes, and wherein a different combination of said light emitting diodes is illuminated or said light emitting diodes are illuminated in a different manner for each one of said plurality of different engine conditions.

4. A system according to claim 3, wherein said plurality of light emitting diodes includes light emitting diodes of at least two different colors.

5. A system according to claim 1, wherein, if said processor categorizes said engine as operating in said idling condition for a predetermined length of time, the processor outputs a signal to the ignition circuit of the engine which shuts the engine down.

6. A system according to claim 2, wherein, if said processor categorizes said engine as operating in said shut down condition for a predetermined length of time, the processor outputs a signal to the ignition circuit of the engine which shuts the engine down.

7. A system according to claim 1, wherein said processor is mounted on a circuit board and operates in accordance with program instructions stored in a program memory which is also mounted on said circuit board.

8. A system according to claim 7, wherein said system further comprises a configuration memory which is also mounted on said circuit board and which stores calibration values for said sensor signal and said output signal.

9. A system according to claim 8, wherein said configuration memory further stores threshold values used by said processor in carrying out said program instructions to categorize said engine as operating in one of the plurality of different engine conditions.

10. A system according to claim 8, wherein said program memory comprises an EPROM and said configuration memory comprises as EEPROM.

11. A system according to claim 1, wherein the system further comprises a voltage regulator for receiving a start signal from an ignition circuit of said engine and providing a voltage to said processor.

12. A system according to claim 1, wherein said processor is configured to be connected to an ignition circuit of said engine via a relay circuit and to output a shut down signal to cause said ignition circuit to be shorted, thereby causing the engine to be shut down.

13. A system according to claim 12, wherein the processor generates said shut down signal when an output signal respectively corresponding to one of said plurality of engine conditions is generated for a predetermined period of time.

14. A method for monitoring the condition of an engine comprising the steps of:

receiving, from a sensor configured to receive the exhaust gas of said engine, a sensor signal representing the oxygen content of said exhaust gas;

processing said sensor signal so as to categorize said engine as operating in one of a plurality of different engine conditions on the basis of said sensor signal, wherein the plurality of different engine conditions comprises a normal condition, a warning condition, an idling condition and a shutdown condition;

generating an output signal representing said one of said plurality of engine conditions; and operating a display in a display state respectively corresponding to said one of said plurality of engine conditions.

15. A method according to claim 14, wherein said method further comprises the steps of:

receiving an ignition signal representing the engine speed of said engine; and processing said sensor signal and said ignition signal to determine whether said engine is operating in one of said plurality of different engine conditions on the basis of said sensor signal and said ignition signal.

16. A method according to claim 14, wherein said step of processing said sensor signal so as to categorize said engine comprises the steps of sequentially comparing a value of said sensor signal to each one of a plurality of threshold values, said threshold values defining the range of values falling within each one of said plurality of conditions.

17. A method according to claim 14, wherein said method comprises the further step of, when said engine is operating in said shutdown condition for a predetermined length of time, outputting a shutdown signal which causes the ignition circuit of the engine to be shorted to ground.

18. A method according to claim 15, wherein said method comprises the further step of, when said engine is categorized as operating in said idling condition for a predetermined length of time, outputting a shutdown signal which causes the ignition circuit of the engine to be shorted to ground.

19. A method according to claim 15, comprising the further steps of, when said engine is categorized as operating in said idling condition for a predetermined period of time, operating said display in a first display state, setting a second predetermined period of time and operating said display in a second display state different than said first display state after said second predetermined period of time elapses.

20. An article of manufacture for monitoring an engine, comprising:

a machine readable storage medium; and program instructions stored on said storage medium;

wherein said stored program instructions is configured to cause said machine to operate to:

detect a sensor signal respectively identifying the oxygen content of the exhaust gas of said engine from a sensor;

process said sensor signal so as to categorize said engine as operating in one of a plurality of different engine conditions on the basis of said sensor signal, wherein the plurality of different engine conditions comprises a normal condition, a warning condition, an idling condition and a shutdown condition;

generate an output signal representing said one of said plurality of engine conditions; and operate a display in a display state respectively corresponding to said one of said plurality of engine conditions.

21. An article of manufacture according to claim 20, wherein said stored program instructions are configured to be readable from said machine readable storage medium by the machine to thereby cause said machine to operate so as to:

receive an ignition signal representing the engine speed of said engine; and process said sensor signal and said ignition signal to determine whether said engine is operating in one of said plurality of different engine conditions on the basis of said sensor signal and said ignition signal.

22. An article of manufacture according to claim 20, wherein said stored computer programming is configured to be readable from said computer readable storage medium by the computer to thereby cause said machine to operate so as to:

sequentially compare a value of said sensor signal to each one of a plurality of threshold values, said threshold values defining the range of values falling within each one of said plurality of conditions.

23. A programmed control system for controlling an engine, comprising:

a processor configured to (i) detect a sensor signal respectively identifying the oxygen content of the exhaust gas of said engine from a sensor, (ii) process said sensor signal so as to categorize said engine as operating in one of a plurality of different engine conditions on the basis of said sensor signal, wherein the plurality of different engine conditions comprises a normal condition, a warning condition, an idling condition and a shutdown condition, and (iii) generate an output signal representing said one of said plurality of engine conditions;

a storage medium configured to store information corresponding to threshold values of the voltage of said sensor signal corresponding to said plurality of different engine conditions; and a display configured to be responsive to said output signal generated by said processor to operate in a display state respectively corresponding to said one of said plurality of engine conditions.

24. A programmed control system according to claim 23, wherein:

said processor is configured to sequentially compare a value of said sensor signal to each one of a plurality of threshold values, said threshold values defining the range of values falling within each one of said plurality of conditions.

* * * * *

UNITED STATES PATENT AND TRADEMARK OFFICE

CERTIFICATE OF CORRECTION

PATENT NO. : 5,819,698
DATED : Oct. 13, 1998
INVENTOR(S) : Harold Leighton

It is certified that error appears in the above-identified patent and that said Letters Patent is hereby corrected as shown below:

Column 5, line 4, change "6" to -- 5 --.

Please delete drawing sheets 3,4 & 5 and substitute drawing sheets 3,4 & 5 as per attached.

Signed and Sealed this

Thirteenth Day of July, 1999

*Attest:*

*Attesting Officer*

Q. TODD DICKINSON

*Acting Commissioner of Patents and Trademarks*